US005573572A

United States Patent [19]

Eckert et al.

[11] Patent Number: 5,573,572

[45] Date of Patent: Nov. 12, 1996

[54] PROCESS FOR THE PRODUCTION OF TANTALUM-NIOBIUM CONCENTRATES

[75] Inventors: Joachim Eckert, Bad Harzburg; Kurt Tolle, Bad Säckingen; Jochen Weber, Laufenburg; Klaus Rieger, Bad Säckingen, all of Germany

[73] Assignee: H. C. Starck, GmbH & Co. KG, Goslar, Germany

[21] Appl. No.: 412,071

[22] Filed: Mar. 28, 1995

[30] Foreign Application Priority Data

Apr. 27, 1994 [DE] Germany ..... 44 14 571.3

[51] Int. Cl.[6] ..... C22B 34/24

[52] U.S. Cl. ..... 75/10.61; 75/622

[58] Field of Search ..... 75/622, 10.61

[56] References Cited

U.S. PATENT DOCUMENTS

| | | | |
|---|---|---|---|
| 2,209,427 | 10/1959 | Rathmann et al. | 75/133.5 |
| 3,721,727 | 3/1973 | Gustison | 423/62 |
| 4,192,674 | 3/1980 | Krismer et al. | 75/10 R |
| 4,211,754 | 7/1980 | Van Hecke et al. | 423/622 |
| 5,322,548 | 6/1994 | Kieffer et al. | 75/622 |

*Primary Examiner*—Melvyn Andrews
*Attorney, Agent, or Firm*—Jerry Cohen

[57] ABSTRACT

Process for the production of tantalum-niobium concentrates from low-tantalum, high-niobium raw materials with an $Nb_2O_5/Ta_2O_5$ ratio of 5 to 15 in a pyrometallurgical concentration process by smelting with carbon-containing reducing agents, reductions and resmelting.

5 Claims, No Drawings

PROCESS FOR THE PRODUCTION OF TANTALUM-NIOBIUM CONCENTRATES

BACKGROUND OF THE INVENTION

The present invention relates to a process for the production of tantalum-niobium concentrates from low-tantalum, high-niobium raw materials with an $Nb_2O_5Ta_2O_5$ ratio of 5 to 15 in a pyrometallurgical concentration process.

Tantalum is generally obtained by wet chemical methods, for example from tantalum concentrates and/or from tin slag arising from smelting tin stone (cassiterite, $SnO_2$). The concentrate may be economically processed by wet chemical methods only if a ratio of tantalum to niobium of 1:5 is not exceeded and the $Ta_2O_5$ content is greater than 10 wt. %.

Tin slag with a low useful material content, the tantalum and niobium oxide content of which is so low that wet chemical processing would be uneconomical, is upgraded by pyrometallurgical processes, for example by reduction with carbon with the addition of slag forming fluxes in an electric-arc furnace to yield synthetic concentrates.

German patent application 27 33 193 thus describes a process for the concentration of tantalum and niobium. The aim of this process is to process high-$TiO_2$ raw materials, wherein titanium and tin are, as far as possible, separated from tantalum and niobium. The useful materials tantalum and niobium are jointly concentrated in a metallic alloying stage, such that both tantalum and niobium are present in metallic form. Aluminium is used as the reducing agent and barytes as the slag forming flux.

U.S. patent application Ser. No. 2,909,427 discloses a process for the production of ferroniobium by means of purposeful reduction. The aim of the process is to produce a low-tantalum ferroniobium containing neither tin nor phosphorus. To this end, tin and phosphorus are reduced in a first stage in a bath of iron in an electric-arc furnace with a basic lining, while tantalum and niobium remain as oxides in the slag. In a second stage, which is also performed in a furnace vessel with a basic lining and with the addition of slag forming fluxes, the tantalum is separated from the niobium. Niobium is reduced to ferroniobium by using aluminium as the reducing agent, while the tantalum is intended as far as possible to remain in the slag. There is no description of a purposeful concentration of tantalum nor of its isolation.

The object of the invention is specifically to make it possible to concentrate tantalum from a low-tantalum, high-niobium raw material with the aim of ensuring that customary wet chemical opening-up of tantalum-niobium concentrates may subsequently be performed economically. The emphasis thus lies upon the isolation of tantalum from raw materials which are high in niobium but low in tantalum. The process is preferably to be used for columbite ores and/or tin slag with a tantalum-niobium ratio of 1:5 to 1:15.

SUMMARY OF THE INVENTION

This object is achieved according to the invention by a process for the production of tantalum-niobium concentrates from low-tantalum, high-niobium raw materials with an $Nb_2O_5/Ta_2O_5$ ratio of 5 to 15 in a pyrometallurgical concentration process, wherein:

(a) the raw materials are smelted with the addition of reducing agents containing carbon and slag forming fluxes in an electric-arc furnace to yield a ferroniobium-tantalum alloy, (b) this alloy is reduced in size mechanically, calcined under oxidizing conditions in suitable plant at 800°–1000° C. and (c) the resultant calcined material is resmelted in an electric-arc furnace with the addition of reducing agents containing carbon and (d) a tantalum-niobium oxide concentrate is separated from the metal phase.

This process is provided by the present invention. Use of this process also makes it possible also to isolate tantalum from low-tantalum, high-niobium raw materials with tantalum contents of less than 5 wt. %, for example tin slags, ores and/or concentrates.

In the first smelting stage of the process according to the invention, the raw materials are reacted with customary slag forming additives and reducing agents containing carbon in an electric-arc furnace. Preferably, petroleum coke, graphite, finely divided coke and/or compacted molasses are used as the reducing agents containing carbon. Calcium oxide, calcium carbonate and/or $SiO_2$ are used as the slag forming fluxes.

The tantalum and niobium are largely reduced in this operation, which is performed in a furnace vessel with a lining containing carbon. This operation produces a molten metal bath substantially comprising a ferroalloy with niobium and tantalum and slag with the impurities (for example a proportion of the $TiO_2$) and gangue fractions (for example $SiO_2$) which may be discharged.

The separated and crushed metal phase is then calcined under oxidizing conditions and resmelted in the electric-arc furnace. This second smelting stage is also performed with a lining containing carbon and using carbon as the reducing agent. The addition of slag forming fluxes is not necessary in this stage. The quantity of reducing agent is here adjusted such that the unwanted oxide components such as $SnO_2$, $WO_3$, $P_2O_5$ and $Fe_2O_3$ are reduced with the stoichiometrically necessary quantity of reducing agent, while for the $Nb_2O_5$, depending upon the desired degree of depletion, 50 to 90% of the stoichiometrically necessary quantity of reducing agent is used.

Particularly good results are achieved when the calcined material is smelted in such a manner that the FeO content of the slag is a maximum of 4 wt. %. Under these conditions, the tantalum remains as $Ta_2O_5$ in the slag phase with the residual, unreduced $Nb_2O_5$, while the resultant iron alloy contains the remainder of the niobium together with the accompanying elements tin, tungsten etc.

It is only by means of the combination and this particular sequence of the various smelting and calcination stages according to the invention that the tantalum may be concentrated from low-tantalum, high-niobium raw materials such that customary wet chemical opening-up of the resultant tantalum-niobium concentrate is economically possible.

DETAILED DESCRIPTION OF PREFERRED EMBODIMENTS

The invention is illustrated by the following example, which should not be considered to delimit the invention.

EXAMPLE (% means always weight %)

60,000 kg of a natural raw material of the following composition: 37% $Nb_2O_5$, 4% $Ta_2O_5$, 20.4% FeO, 3.5% $TiO_2$, 3.2% $SnO_2$, 3.7% MnO, 3.3% $SiO_2$, 6% PbO, 1% $Al_2O_3$, 2% $ZrO_2$ were smelted with the addition of 30,000 kg of finely divided coke and 3,500 kg of CaO in an electric-arc furnace operated at a power of 2 MW to yield 33,800 kg of a ferroalloy of the following composition: 46.8% niobium, 5.93% tantalum, 28.9% iron, 0.3% phosphorus, 2.1% tin, 1.5%. manganese.

This alloy was reduced in size to <1 mm in crushers and calcined under oxidizing conditions in an eight stage calcining kiln at 800° C.

Analysis of the 43,415 kg of calcined material revealed the following values: 51.9% $Nb_2O_5$, 5.6% $Ta_2O_5$, 31.1% $Fe_2O_3$, 0.6% $P_2O_5$, 2.0% $SnO_2$ and 1.5% MnO, 1.5% $TiO_2$, 1.7% $SiO_2$.

This calcined material was smelted under reducing conditions in an electric-arc furnace with the addition of 9,215 kg of finely divided coke, such that 80% of the introduced quantity of $Nb_2O_5$ was purposefully reduced and so passed into the resultant cast iron.

On conclusion of the test, 26,500 kg of a cast iron were produced containing 41% niobium, 0.5% tungsten, 47.1% iron, 0.4% phosphorus, 3.3% tin together with 7,750 kg of a high-tantalum tantalum-niobium concentrate containing 24.9% $Ta_2O_5$, 50.1% $Nb_2O_5$, 9.3% $SiO_2$, 7.1% MnO, 7.7% $TiO_2$ and 2.3% CaO.

In relation to the raw material used, the $Ta_2O_5/Nb_2O_5$ ratio was improved from 1:9.25 to 1:2.

We claim:

1. Process for the production of niobium-tantalum concentrates with high-tantalum content relative to niobium from low-tantalum, high-niobium raw materials with an $Nb_2O_5/Ta_2O_5$ ratio of 5 to 15, and a multiple metals content in the form of oxides of the metals including iron oxide content in excell of 4 wt-%, in a pyrometallurgical process comprising the steps of:

(a) smelting the raw materials in an electric arc in the presence of reducing agent material comprising carbon and slag forming material comprising fluxes, to yield a ferroniobium-tantalum alloy product, (b) separating the alloy product from slag, (c) mechanically processing the ferroalloy product to a desired size, (d) calcining the alloy product at 800°–1,000° C. under oxidizing conditions, (e) resmelting the alloy in an electric arc in the presence of reducing agent material comprising carbon to produce a metal phase with one or more metals therein including most of the original niobium of the raw material, and a tantalum-niobium oxide concentrate product that is easily separatable from the metal phase.

2. Process according to claim 1, characterized in that the reducing agent containing carbon is selected from the group consisting of petroleum coke, graphite, finely divided coke and compacted molasses.

3. Process according to either one of claims 1 or 2, characterized in that the slag forming flux is selected from the group consisting of calcium oxide, calcium carbonate and $SiO_2$.

4. Process according to claim 3, characterized in that the calcined material is smelted in such a manner that the FeO content of the slag is a maximum of 4 wt %.

5. Process according to either of claims 1 or 2, characterized in that the calcined material is smelted in such a manner that the FeO content of the slag is a maximum of 4 wt %.

* * * * *